US006227706B1

(12) United States Patent
Tran

(10) Patent No.: US 6,227,706 B1
(45) Date of Patent: May 8, 2001

(54) TWO PIECE, COMPRESSIBLE STORAGE SATCHEL FOR COMPRESSIBLE ARTICLES

(76) Inventor: Thoai S. Tran, 258 E. 6th St., Erie, PA (US) 16507

( * ) Notice: Subject to any disclaimer, the term of this patent is extended or adjusted under 35 U.S.C. 154(b) by 0 days.

(21) Appl. No.: 09/603,551

(22) Filed: Jun. 26, 2000

(51) Int. Cl.[7] ..... B65D 33/01

(52) U.S. Cl. ..... 383/103; 206/524.8; 220/615; 220/617; 383/63; 383/81; 383/80; 383/95; 383/113; 383/116

(58) Field of Search ..... 383/93, 95, 81, 383/80, 103, 63, 113, 116, 44; 206/524.8; 220/745, 666, 617, 615, 203.29

(56) References Cited

U.S. PATENT DOCUMENTS

| | | | | |
|---|---|---|---|---|
| 1,228,652 | * | 6/1917 | Daugherty | 383/95 X |
| 3,620,409 | * | 11/1971 | Rosenbaum | 206/524.8 |
| 3,690,903 | * | 9/1972 | Thomka | 206/524.8 |
| 4,792,983 | * | 12/1988 | Allegre | 383/93 X |
| 5,450,963 | * | 9/1995 | Carson | 206/524.8 |
| 5,480,030 | * | 1/1996 | Sweeney et al. | 206/524.8 |
| 5,881,881 | * | 3/1999 | Carrington | 206/524.8 |
| 5,941,391 | * | 8/1999 | Jury | 206/524.8 |
| 6,059,457 | * | 5/2000 | Speche et al. | 206/524.8 |
| 6,109,915 | * | 8/2000 | Duboff | 220/617 X |

FOREIGN PATENT DOCUMENTS

| | | | | |
|---|---|---|---|---|
| 241328 | * | 7/1965 | (DE) | 383/81 |
| 408522 | * | 3/1957 | (EP) | 383/80 |
| 504679 | * | 3/1957 | (IT) | 383/80 |

* cited by examiner

*Primary Examiner*—Allan N. Shoap
*Assistant Examiner*—Robin A Hylton
(74) *Attorney, Agent, or Firm*—Richard K. Thomson

(57) ABSTRACT

A tubular first member receives a compressible article and, a flat circular member is zip-locked to the first member to create a waterproof, gas-impermeable protective satchel for the article. A one-way valve secured to one of the first and second members allows the compressible article and the satchel containing it to be squeezed to drive out any excess air stored within the article allowing it to be stored at a volume which is as much as 50% reduced from its normal volume.

8 Claims, 1 Drawing Sheet

40
34

22
34
28
32
30

34
28
32
30
22

40
44
48
46
42

20
26
30
22
40
24

TWO PIECE, COMPRESSIBLE STORAGE SATCHEL FOR COMPRESSIBLE ARTICLES

BACKGROUND AND SUMMARY OF THE INVENTION

The present invention is directed to a satchel for storing compressible articles. More particularly, the present invention is directed to a satchel equipped with a one-way valve that permits air to be forced out of the compressible article to minimize its stored size.

Certain applications put space at a premium. One such application is back packing. When heading into the wilderness with everything necessary for survival compacted into an area sufficiently small to place upon your back, a person does not have the luxury of allowing her/his sleeping bag, for example, to take up its normal volume. Several patents teach the means of reducing the volume of stored items using a vacuum to pull suction on a storage bag. While this may be an acceptable solution for household applications, when back packing in the wilderness, this solution is not of any particular benefit since a source of vacuum is not readily available.

The present invention provides a storage satchel for compressible articles including a generally tubular first member with a first closed end and a second open end, the first member being constructed of waterproof, gas-impermeable material, the second open end having a first peripheral portion equipped with a first one of a dovetail protrusion element and a complementarily shaped recess element. A second member is constructed of a waterproof, gas-impermeable material and has a second peripheral portion equipped with a second one of the dovetail protrusion element and the complementarily shaped recess element. A one-way valve is attached to one of said first and second members, the valve only permitting trapped air to flow out of said satchel. A compressible article may be inserted into the first member, the first and second elements zip-locked together to form a gas-impermeable satchel and, the satchel with the compressible article compressed to drive out trapped air and, thereby, store the compressible article in a significantly compressed condition. The waterproof gas-impermeable materials of the first and second members can be the same material or may be different materials. Preferably, the two members are made of the same material which is a nylon oxford. If a second material is used, a nylon coated with an elastomer may be used for the second member. The second member is preferably of a greater thickness than the first member and will function as a bottom for the satchel. The thicker material for the ground-engaging portion of the satchel will provide greater durability. Preferably, the peripheral portion of the first member receiving the first fastener member is an interior portion and the peripheral portion of the second member receiving the second fastener member is an outer edge portion of a generally flat, circular member.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figures 1, 2, 3A, 3B, 4:
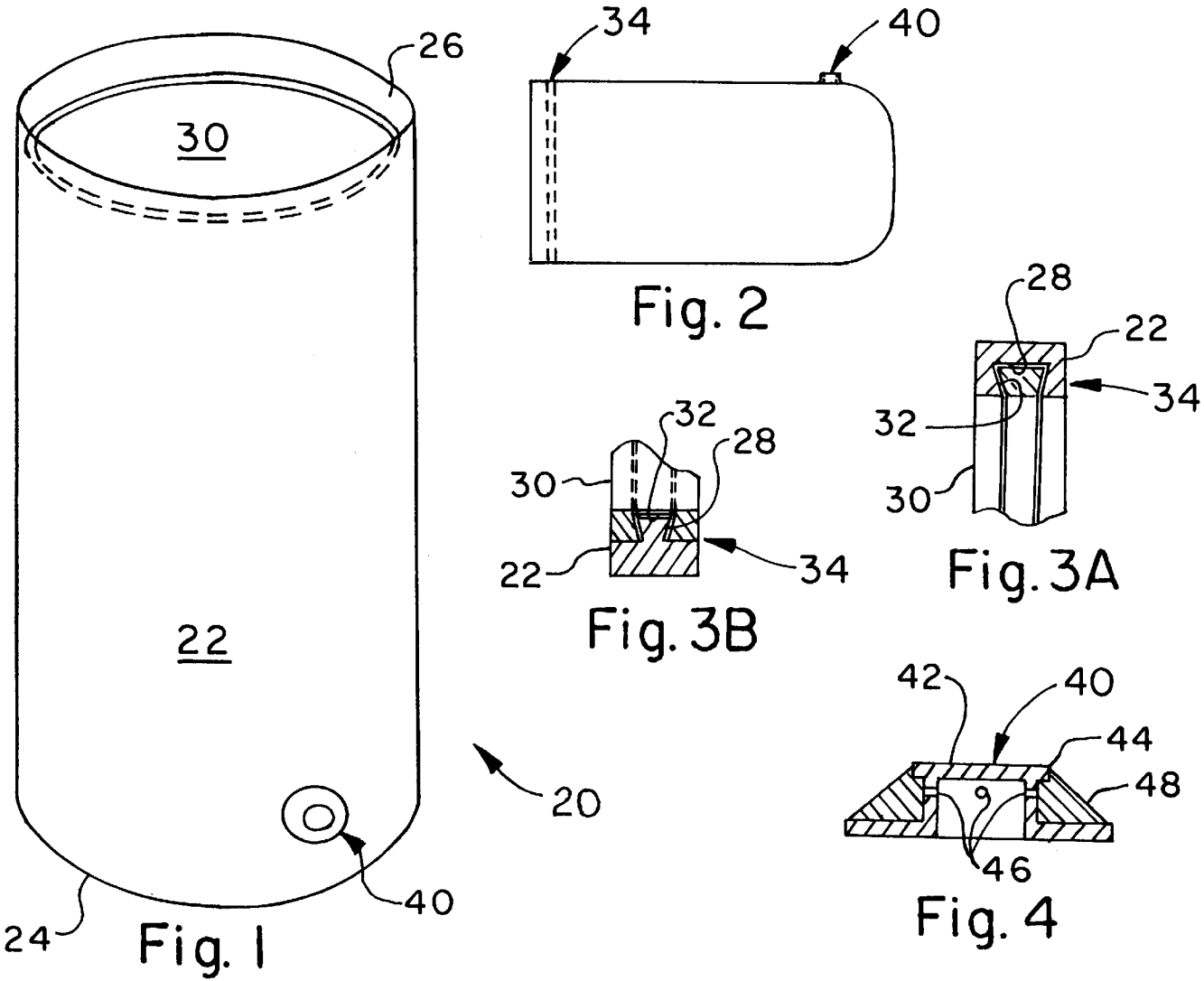
FIG. 1 is a perspective view of a first embodiment of the storage satchel of the present invention.
FIG. 2 is a side view of the first embodiment.
FIG. 3A is a detail side view of a first embodiment of the dovetail seal arrangement used on the satchel of the present invention.
FIG. 3B is a detail side view of a second embodiment of the dovetail seal arrangement.
FIG. 4 is a detailed cross-sectional view of the one-way valve used in the first embodiment of the satchel of the present invention.

A first embodiment of the storage satchel for compressible articles is shown in FIG. 1 generally at 20. Storage satchel 20 is made of a first generally tubular member 22 which has a first closed end 24 and a second open end 26. Member 22 is made of a first waterproof, gas-impermeable material and second end 26 has a peripheral portion that is equipped with either a dovetail protrusion element 28 (FIG. 3B) or a complementarily shaped recess element 32 (FIG. 3A). Dovetail protrusion 28 and recess 32 are preferably made of styrene-butadiene rubber (SBR) which is bonded to its respective first (22) or second (30) member. Second member 30 is preferably a generally flat, circular member having the other of the dovetail recess 32 (FIG. 3B) and complementarily shaped protrusion 28 (FIG. 3A) formed on an outer peripheral edge 34. The second member 30 can be zipped together into sealing engagement with first member 22 by means of the interengaging protrusion 28 and recess 32 to form a seal 34 for gas-impermeable satchel 20 which secures the contents against wetness. This is particularly important in back packing applications to prevent bedding, clothing and the like from being soaked by rains or river water should a canoe or raft carrying the back packer tip dumping satchel 20 into the river.

One of the first (22) and second (30) members is equipped with a one-way valve 40. Valve 40 is also preferably made of SBR that is bonded to the nylon oxford of first member 22. Alternatively, valve 40 could be bonded to second member 30, if desired. One-way valve 40 has a first element 42 with an overhanging flange 44 and a plurality (four shown) of outlet openings 46. Second element 48 surrounds the projecting portion 45 of first element 42 overlying openings 46 so as to close them off and prevent ingress of atmospheric air. O-ring groove 50 is formed in projecting portion 45 and, if no O-ring is inserted, second element 48 will bulge into groove 50 helping overhanging flange 44 retain second element 48 on projecting portion 45.

In use, a compressible article such as a sleeping bag is inserted in tubular first member 22 and second member 30 is zip-locked thereto by inserting dovetail member 28 into groove 32 to seal the two members together and create a water-proof, gas-impermeable sheath which surrounds the enclosed article. The compressible article and the satchel 20 which surrounds it may be squeezed to drive out any trapped air. One-way valve 40 allows air to escape from the sealed satchel 20 so that the enclosed article may be stored in a significantly compressed condition, perhaps 50% reduction in volume. As noted earlier, for certain applications, such as backpacking, such a volume reduction is critical to being able to carry everything needed for any given trek.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A satchel for storing compressible articles in a significantly compressed condition, said satchel comprising:

a) a substantially tubular first member with a first closed end and a second open end, said first member being constructed of a first waterproof, gas-impermeable, flexible, compressible material, said second open end having a first peripheral portion equipped with a first one of a dovetail protrusion element and a complementarily shaped recess element;

b) a second member constructed of a second waterproof, gas-impermeable, flexible, compressible material and having a second peripheral portion equipped with a second one of said dovetail protrusion element and said complementarily shaped recess element;

c) a one-way valve attached to one of said first and second members, said valve only permitting trapped air to flow out of said satchel;

wherein a compressible article may be inserted in said first member, said first and second elements zip-locked together to form a gas-impermeable satchel and, said satchel with the compressible article compressed to drive out trapped air and, thereby, store the compressible article in a significantly compressed condition.

2. The satchel of claim 1 wherein said second member comprises a substantially flat, circular member.

3. The satchel of claim 2 wherein said first peripheral portion comprises an inner peripheral portion and said second peripheral portion comprises an outer edge portion of said generally flat, circular second member.

4. The satchel of claim 1 wherein said first waterproof, gas-impermeable material of said first member and said second waterproof, gas-impermeable material of said second member are the same material.

5. The satchel of claim 4 wherein the waterproof, gas-impermeable material is a nylon oxford.

6. The satchel of claim 5 wherein a thickness of the second material is greater than a thickness of said first material.

7. The satchel of claim 1 wherein said first waterproof, gas-impermeable material of said first member and said second waterproof, gas-impermeable material of said second member are different materials.

8. The satchel of claim 7 wherein said first waterproof, gas-impermeable material of said first member is a nylon oxford and said second waterproof, gas-impermeable material of said second member is a nylon treated with an elastomeric coating.

* * * * *